US012727668B2

(12) United States Patent
Li

(10) Patent No.: US 12,727,668 B2
(45) Date of Patent: Sep. 8, 2026

(54) STORAGE BOX

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 0 days.

(21) Appl. No.: 18/914,150

(22) Filed: Oct. 12, 2024

(65) Prior Publication Data

US 2025/0031845 A1 Jan. 30, 2025

Related U.S. Application Data

(63) Continuation-in-part of application No. 18/624,172, filed on Apr. 2, 2024, which is a continuation of application No. PCT/CN2024/081699, filed on Mar. 14, 2024.

(30) Foreign Application Priority Data

| | | |
|---|---|---|
| Jul. 6, 2023 | (CN) | 202321774219.8 |
| Jan. 31, 2024 | (CN) | 202410138051.4 |
| Jan. 31, 2024 | (CN) | 202420241777.6 |

(51) Int. Cl.
*A47B 67/04* (2006.01)
*A47B 88/40* (2017.01)

(52) U.S. Cl.
CPC ..... *A47B 67/04* (2013.01); *A47B 88/40* (2017.01); *A47B 2088/4015* (2017.01)

(58) Field of Classification Search
CPC ..... A47B 67/04; A47B 88/40; A47B 88/413; A47B 2088/4015
USPC ..... 312/290, 902
See application file for complete search history.

(56) References Cited

U.S. PATENT DOCUMENTS

| | | | | | |
|---|---|---|---|---|---|
| 1,984,345 | A | * | 12/1934 | Kennedy | B25H 3/02 220/515 |
| 2,704,699 | A | * | 3/1955 | Evans | A47B 67/04 312/334.44 |
| 4,662,515 | A | * | 5/1987 | Newby, Sr. | B25H 3/02 312/258 |

(Continued)

FOREIGN PATENT DOCUMENTS

| | | |
|---|---|---|
| CN | 205418476 U | 8/2016 |
| CN | 207278033 U | 4/2018 |

(Continued)

OTHER PUBLICATIONS

International Search Report of PCT/CN2024/081699.

(Continued)

*Primary Examiner* — James O Hansen

(57) ABSTRACT

A storage box is provided. The storage box includes two first side walls, a second side wall and a bottom wall. The two first side walls are connected to two sides of the second side wall, respectively; and the two first side walls are opposite to each other. The second side wall and the two first side walls are fixedly connected to the bottom wall, respectively; and the bottom wall, the second side wall and the two first side walls are enclosed together to form a first accommodation space.

3 Claims, 12 Drawing Sheets

(56) References Cited

U.S. PATENT DOCUMENTS

| | | | | |
|---|---|---|---|---|
| 5,743,605 | A | 4/1998 | Marino | |
| 5,927,838 | A * | 7/1999 | Hellman, Jr. | F16B 12/38 312/263 |
| 6,375,235 | B1 * | 4/2002 | Mehmen | E05C 3/14 292/128 |
| 6,736,265 | B2 * | 5/2004 | Kipper | B25H 3/028 206/811 |
| 7,264,319 | B2 | 9/2007 | Cheng | |
| 8,348,357 | B2 * | 1/2013 | Briggs | E05B 65/462 312/219 |
| 9,504,323 | B1 * | 11/2016 | Porreca | A47B 88/407 |
| 9,962,826 | B1 * | 5/2018 | Surridge | B25H 3/028 |
| 2019/0039233 | A1 * | 2/2019 | Liu | B25H 3/028 |
| 2024/0269821 | A1 * | 8/2024 | Li | B25H 3/028 |
| 2025/0031845 | A1 | 1/2025 | Li | |

FOREIGN PATENT DOCUMENTS

| | | | |
|---|---|---|---|
| CN | 111692821 | A | 9/2020 |
| CN | 211996557 | U | 11/2020 |
| CN | 214876939 | U | 11/2021 |
| CN | 218921945 | U | 4/2023 |
| CN | 220375019 | U | 1/2024 |
| KR | 20120006215 | U | 9/2012 |

OTHER PUBLICATIONS

Notice of first review opinion of 202420241777.6.
First notice of examination opinions of CN202510097820.5.
Non-Final Office Action of U.S. Appl. No. 18/624,172 mailed May 6, 2025.
Final Office Action of U.S. Appl. No. 18/624,172.

* cited by examiner

STORAGE BOX

CROSS-REFERENCE TO RELATED APPLICATIONS

This application is a continuation in part of patent application Ser. No. 18/624,172, filed on Apr. 2, 2024, the patent application Ser. No. 18/624,172 is a continuation of international patent application No. PCT/CN2024/081699, filed on Mar. 14, 2024, which itself claims priority to Chinese patent application Nos. 202321774219.8, filed on Jul. 6, 2023, and titled "STORAGE BOX"; 202410138051.4, filed on Jan. 31, 2024, and titled "STORAGE BOX"; 202420241777.6, filed on Jan. 31, 2024, and titled "STORAGE BOX". The contents of the above identified applications are hereby incorporated herein in their entireties by reference.

TECHNICAL FIELD

The present disclosure relates to the field of storage containers technology, and in particular, to a storage box.

BACKGROUND

A storage box serves as a storage container primarily employed for organizing and storing items, and has been widely used in various scenarios such as workshop production, household activities, and daily office routines. Conventionally, the storage box is constructed by enclosing multiple iron sheets, leaving an opening on one side for users to access and store items. Nonetheless, it is often inconvenient for users to retrieve and place items in the storage box.

SUMMARY

According to various embodiments of the present disclosure, a storage box is provided.

A storage box includes two first side walls, a second side wall and a bottom wall, the two first side walls are connected to two sides of the second side wall, respectively. The two first side walls are opposite to each other, the second side wall and the two first side walls are fixedly connected to the bottom wall, respectively. And the bottom wall, the second side wall and the two first side walls are enclosed together to form a first accommodation space.

In some embodiments, the second side wall and the two first side walls are an integrated structure. Alternatively, the second side wall and the bottom wall are an integrated structure.

In some embodiments, the storage box further includes a cover and a drawer, the cover is connected to a side of the second side wall away from the bottom wall and is capable of rotating relative to the second side wall, the drawer is installed in the first accommodation space and is capable of sliding towards or away from the second side wall.

In some embodiments, the storage box further includes a slide rail component and a mounting frame, the mounting frame is fixedly connected to the two first side walls, and the drawer is in sliding fit with the mounting frame through the slide rail component.

In some embodiments, the slide rail component includes a fixing member and a sliding fitting. The fixing member is fixed on the mounting frame, the sliding fitting is fixed on the drawer, and the sliding fitting is slidably connected to the fixing member.

In some embodiments, the fixing member is provided with a chute, the sliding fitting is provided with a flange, and the flange is slidably arranged in the chute.

In some embodiments, a side of each of the two first side walls away from the second side wall is provided with a stopping portion, and the stopping portion is configured for preventing the mounting frame from escaping out of the first accommodation space in a direction away from the second side wall.

In some embodiments, the stopping portion includes a first edgefold and a second edgefold which are arranged at an included angle, the first edgefold is connected to the two first side walls, and the second edgefold is arranged opposite to the two first side walls. The mounting frame includes a mounting portion and an abutting portion which are arranged at an included angle, and the abutting portion is in contact with the first edgefold to prevent the mounting frame from detaching from the two first side walls in a direction away from the second side wall. The mounting portion is in contact with the second edgefold to prevent the mounting frame from detaching from the two first side walls and moving toward a center of the first accommodation space.

In some embodiments, the storage box further includes a locking member, the locking member includes a first section and a second section which are connected. The first section is fixedly connected to the cover, the second section extends into the first accommodation space. With a rotation of the cover relative to the second side wall, the second section is capable of moving to insert into the drawer and blocking the drawer from moving away from the second side wall, alternatively the second section is capable of moving out of the drawer to allow the drawer to move away from the second side wall.

In some embodiments, the abutting portion further includes a spring section, and the first section is rotatably connected to the second section through the spring section. The storage box further includes a guide, the guide is fixed on the second side wall, and the second section is slidably installed in the guide.

In some embodiments, the storage box further includes a first magnet and a second magnet. The first magnet is fixedly connected to the second side wall, the second magnet is fixedly connected to a side of the drawer adjacent to the second side wall, the drawer is capable of being adsorbed on the second side wall through a mutual attraction between the first magnet and the second magnet.

In some embodiments, the storage box further includes a top wall, and the top wall is fixedly connected with the two first side walls and the second side wall, respectively. The top wall is relatively located above the drawer along a height direction of the storage box, and the top wall and the cover are enclosed above the drawers to form a second accommodation space.

In some embodiments, the storage box further includes a safety lock, the safety lock is installed at a junction of the cover and the top wall, and the safety lock is configured for locking the cover to the top wall.

In some embodiments, the safety lock includes a locking hook and a locking catch, the locking hook is fixedly connected to an outer wall of one of the cover and the top wall, the locking catch is rotatably connected to an outer wall of the other one of the cover and the top wall. The locking catch includes a locking hole, the locking catch is capable of rotating to be sleeved on a periphery of the locking hook through the locking hole, and the locking catch matches with the locking hook and is by the locking hook.

In some embodiments, the safety lock is located in the second accommodation space, the safety lock includes a locking hook and a locking catch, the locking catch is fixedly connected to the cover, and the locking catch includes a locking hole. The top wall is provided with a through hole, the locking hook is slidably connected to the top wall, and at least one part of the locking hook is exposed through the through hole; the locking hook is capable of sliding to be inserted into the locking hole and is limited by the locking hole.

In some embodiments, the storage box further includes a handle, and the handle is connected to the cover.

In some embodiments, the cover is provided with a groove, the handle is accommodated in the groove, and two end parts of the handle are slidably connected to a bottom wall of the groove, respectively. When an external force acts on the handle, the two ends of the handle is capable of approaching towards each other, and an operation space is formed between a middle part of the handle and the cover.

In some embodiments, the cover is provided with two limiting columns, the two limiting columns are arranged in the groove at intervals, two end parts of the handle are provided with an elongated hole, respectively, and the elongated hole extends along a length direction of the handle. Each of the two limiting columns penetrates through one of the elongated holes, and an end of each of the two limiting columns away from the cover is in contact with an edge of the elongated hole, and each of the two limiting columns is capable of being movably matched with the elongated hole along the length direction of the handle.

In some embodiments, a length of the storage box is defined as X, the length X of the storage box is in a range of 200 mm to 600 mm, a width of the storage box is defined as Y, the width Y of the storage box is in a range of 100 mm to 400 mm, and a height of the storage box is defined as Z, the height Z of the storage box is in a range of 100 mm to 600 mm.

In some embodiments, the storage box further includes a top wall and a drawer, the top wall is fixedly connected with the two first side walls and the second side wall, and the top wall is relatively located above the drawers along a height direction H of the storage box.

In some embodiments, the top wall includes a shelf parallel to the bottom wall; along the height direction H of the storage box, a plane where the shelf is located is lower than top edges of the two first side walls and a top edge of the second side wall which are away from the bottom wall, and the top wall, the two first side walls and the second side wall are enclosed above the drawers to form a third accommodation space.

In some embodiments, the top wall further includes a side plate extending from an edge of the shelf, the side plate is perpendicular to the shelf and is configured for being connected with the two first side walls or the second side wall by welding.

In some embodiments, an extension direction of the side plate is away from the bottom wall, and the side plate does not protrude from the third accommodation space.

In some embodiments, the top wall further includes a baffle, and the baffle includes a first plate body and a second plate body which are bent and connected with each other; the first plate body extends toward the bottom wall along an edge of the shelf away from the second side wall, and the second plate body extends toward the second side wall along an edge of the first plate body away from the shelf.

Details of one or more embodiments of this application are presented in the attached drawings and descriptions below. And other features, purposes and advantages of this application will become apparent from the description, drawings and claims.

BRIEF DESCRIPTION OF THE DRAWINGS

For a better description and illustration of embodiments and/or examples of those disclosures disclosed herein, reference may be made to one or more attached drawings. Additional details or examples used to describe the drawings should not be considered as limiting the scope of any of the disclosed disclosures, currently described embodiments and/or examples, and currently understood best modes of these disclosures.

Figure 1:
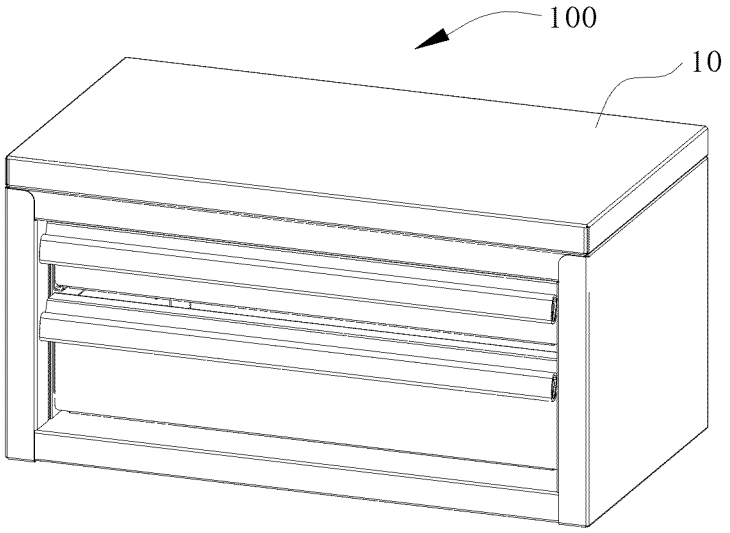
FIG. 1 is a schematic view of a storage box according to an embodiment in the present disclosure.

Reference signs are as follows: 100 represents a storage box; 10 represents a box assembly; 11 represents a first side wall; 111 represents a stopping portion; 111*a* represents a first edgefold; 111*b* represents a second edgefold; 12 represents a second side wall; 13 represents a bottom wall; 14 represents a top wall; 141 represents a through hole; 142 represents a shelf; 143 represents a side plate; 144 represents a baffle; 1441 represents a first plate body; 1442 represents a second plate body; 104 represents a third accommodation space; 105 represents a gap; 15 represents a cover; 151 represents a groove; 152 represents a limiting column; 153 represents a limiting member; 154 represents a clamping hole; 16 represents a first accommodation space; 17 represents a second accommodation space; 18 represents a hinge; 20 represents a drawer; 30 represents a slide rail component; 31 represents a fixing member; 311 represents a chute; 32 represents a sliding fitting; 321 represents a flange; 33 represents a screw; 40 represents a mounting frame; 41 represents a mounting portion; 411 represents a step structure; 42 represents a abutting portion; 42*a* represents a first abutting portion; 42*b* represents a second abutting portion; 50 represents a locking member; 51 represents a first section; 52 represents a second section; 53 represents a spring section; 60 represents a guide; 70 represents a safety lock; 71 represents a locking hook; 711 represents a hook body; 712 represents a shell; 713 represents an elastic return member; 72 represents a locking catch; 721 represents a locking hole; 81 represents a first magnet; 82 represents a second magnet; 90 represents a handle; and 91 represents an elongated hole.

DETAILED DESCRIPTION

To make the above-mentioned objects, features and advantages of the present disclosure more apparent and easier to understand, and the specific embodiments of the present disclosure are described in detail below with reference to the accompanying drawings. Numerous specific details are set forth in the following description to facilitate a sufficient understanding of the present disclosure. However, the present disclosure can be implemented in many other ways different from that described herein, and a person skilled in the art may perform similar improvements without departing from the connotation of the present disclosure, and therefore, the present disclosure is not limited by the specific embodiments disclosed below.

It should be noted that if an element is referred to as being "fixed to" or "disposed on" another element, it may be directly on another element or intervening elements may also be present. If one element is considered to be "connected" another element, it may be directly connected to another element or may have a centering element at the same time. If present, the terms "vertical", "horizontal", "upper", "lower", "left", "right", and the like used in this application are for illustrative purposes only and are not shown as unique implementations.

In addition, if these terms "first" and "second" appear, these terms are only used for descriptive purposes, and cannot be understood as indicating or implying relative importance or implicitly indicating the number of indicated technical features. Thus, the features defined with "first" and "second" may explicitly or implicitly include at least one of the features. In the description of the present disclosure, if there is a term "a plurality of", the meaning of "a plurality of" is at least two, for example, two, three, etc., unless specifically defined otherwise.

In the present disclosure, unless expressly specified and defined otherwise, if there is a similar description of the first feature in the second feature "upper" or "lower", the meaning may be that the first feature is in direct contact with the second feature, or the first feature and the second feature are indirectly in contact with each other by means of the intermediate medium. Moreover, the first feature "above", "above", and "upper" of the second feature may be that the first feature is directly above or obliquely above the second feature, or merely indicates that the first feature horizontal height is higher than the second feature. The first feature "below", "lower", and "lower surface" of the second feature may be that the first feature is directly below or obliquely below the second feature, or merely indicates that the first feature horizontal height is less than the second feature.

Unless otherwise defined, all technical and scientific terms used herein have the same meaning as commonly understood by those skilled in the technical field of this application. The terminology used herein in the specification of this application is only for the purpose of describing specific embodiments, and is not intended to limit this application. As used herein, the term "or/and" includes any and all combinations of one or more related listed items.

Figure 2:
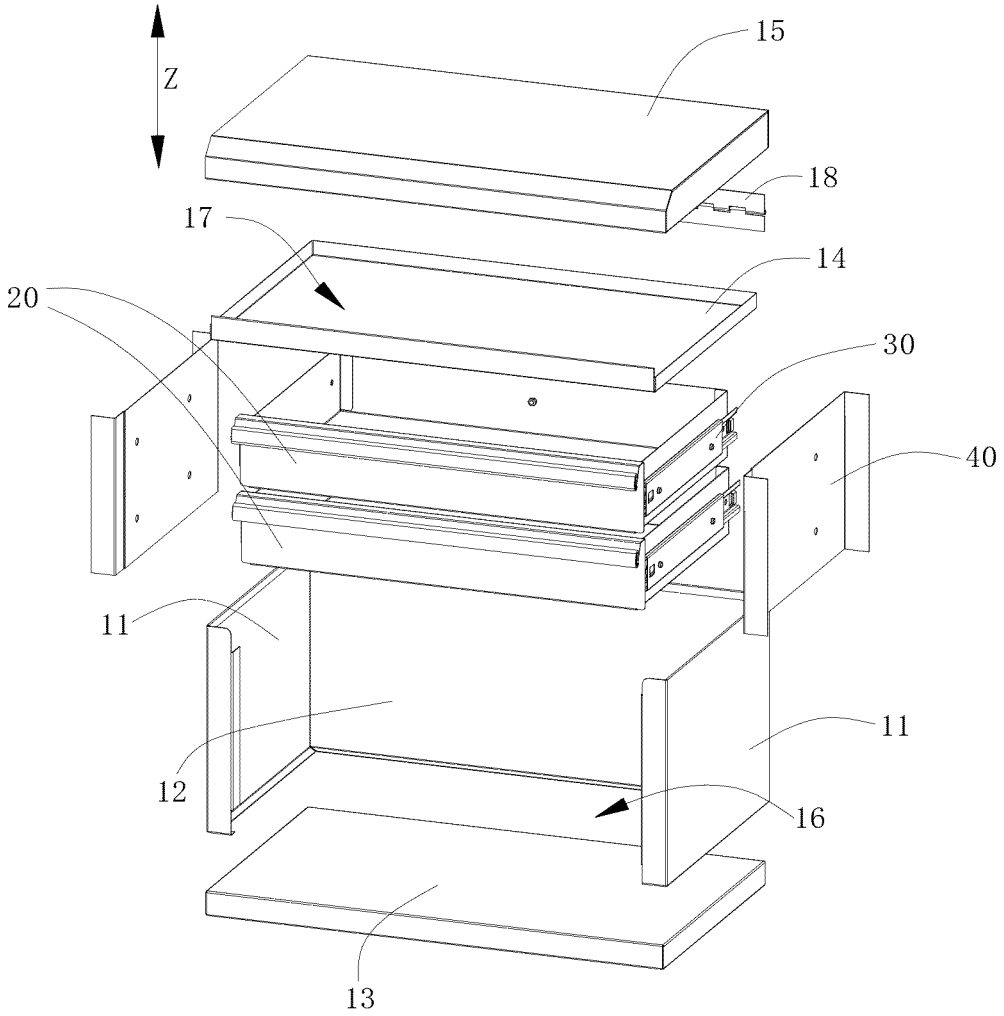
FIG. 2 is an exploded view of a storage box according to an embodiment in the present disclosure.
Figure 3:
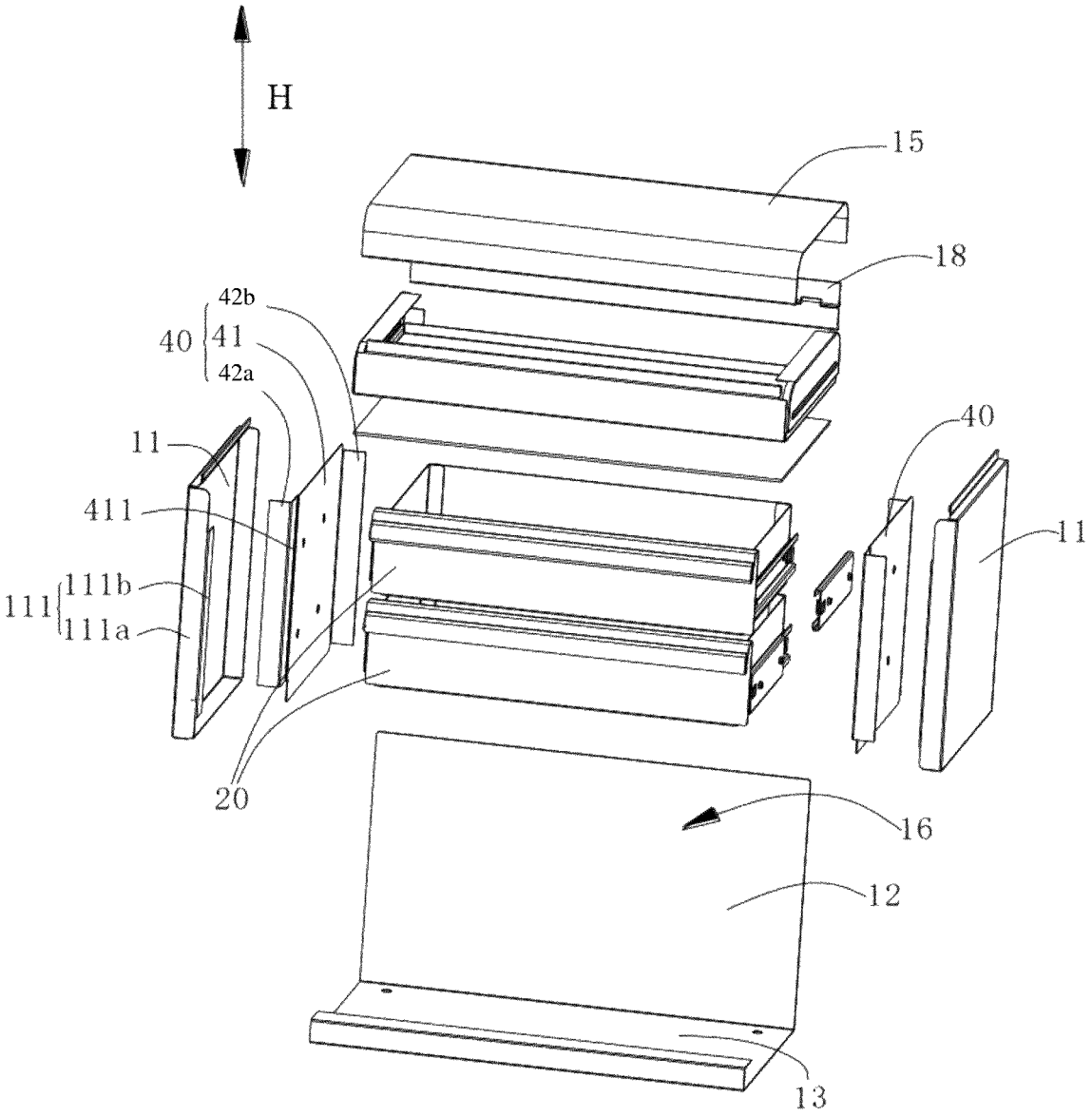
FIG. 3 is an exploded view of a storage box according to an embodiment in the present disclosure.

Referring to FIG. 1 to FIG. 3, the present disclosure provides a storage box 100. The storage box 100 includes a box assembly 10. The box assembly 10 includes two first side walls 11, a second side wall 12 and a bottom wall 13. The two of first side walls 11 are connected to two sides of the second side wall 12, respectively. The two first side walls 11 are opposite to each other, the second side wall 12 and the two first side walls 11 are fixedly connected to the bottom wall 13, respectively. And the bottom wall 13, the second side wall 12 and the two first side walls 11 are enclosed together to form a first accommodation space 16.

In this way, the first accommodation space 16 is configured for accommodating articles, and an opening communicating with the first accounting space 16 is formed between the two first side walls 11 and the second side wall 12. An opening communicating with the first accommodation space 16 is formed between the two first side walls 11 and the bottom wall 13, and users can access and store articles from two different directions of the storage box 100 through these two openings, so that the storage box 100 can be applied to more usage scenarios.

In an embodiment, referring to FIG. 2, the second side wall 12 and the two first side walls 11 are an integrated structure. In this way, welding points between the second side wall 12 and the two first side walls 11 are eliminated, and only the bottom wall 13 needs to be welded to the integrated structure, thus reducing an assembly process required for assembling the storage box 100. It improves an assembly efficiency of the storage box 100, and the integrated structure can also improve a flatness of a side wall surface of the storage box 100, thus protecting the articles in the storage box 100.

In another embodiment, referring to FIG. 3, the second side wall 12 and the bottom wall 13 can be an integrated structure. In this way, not only the assembly process required for assembling the storage box 100 is reduced, but also the assembly efficiency of the storage box 100 is improved, and an adjacent angled edges of the integrated structure can also play a great role in positioning, thus facilitating the welding of the two first side walls 11 to the integrated structure, respectively.

Referring to FIG. 2 and FIG. 3, the box assembly 10 further includes a cover 15, and the cover 15 is connected to a side of the second side wall 12 away from the bottom wall 13 and is capable of rotating relative to the second side wall 12. The storage box 100 further includes a drawer 20, the drawer 20 is installed in the first accommodation space 16 and is capable of sliding towards or away from the second side wall 12.

In this way, the storage box 100 can be opened in two directions. One way is that the drawer 20 can slide away from the second side wall 12, thus facilitating users to access and store articles from the drawer 20. The other way is that the storage box 100 can be opened by turning the cover 15 outward relative to the first accommodation space 16.

The cover 15 is rotatably connected to a side of the second side wall 12 away from the bottom wall 13 through a hinge 18.

Figure 4:
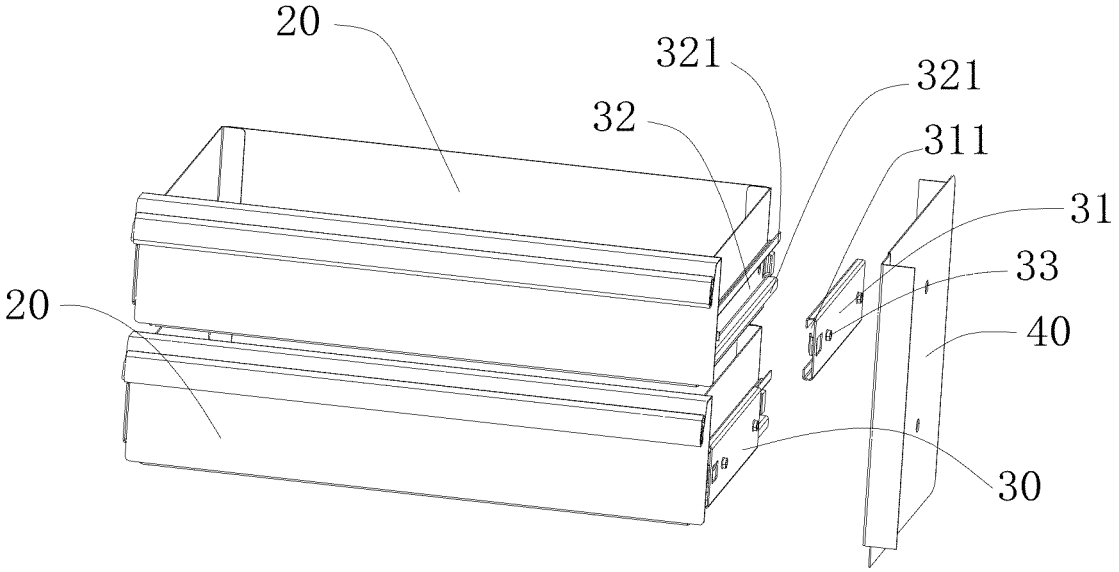
FIG. 4 is an exploded view of a drawer, a slide rail component and a mounting frame.

Referring to FIG. 2 to FIG. 4, the storage box 100 further includes a slide rail component 30 and a mounting frame 40, the mounting frame 40 is fixedly connected to the two first side walls 11, and the drawer 20 is slidable and matches with the mounting frame 40 through the slide rail component 30. With this arrangement, the drawer 20 can be slidably connected with the two first side walls 11 through the slide rail component 30 and the mounting frame 40.

Furthermore, the slide rail component 30 includes a fixing member 31 and a sliding fitting 32, and the fixing member 31 is fixed on the mounting frame 40. The sliding fitting 32 is fixed on the drawer 20, and the sliding fitting 32 is slidably engaged with the fixing member 31. In this way, the drawer 20 can slide with the sliding fitting 32 relative to the fixing member 31, thus realizing a sliding connection between the drawer 20 and the mounting frame 40. The sliding fitting 32 and the fixing member 31 can be fixedly connected to the drawer 20 and the mounting frame 40 through the screw 33, respectively.

In an embodiment, the fixing member 31 is provided with a chute 311, the sliding fitting 32 is provided with a flange 321, and the flange 321 is slidably inserted in the chute 311. In this way, a connection between the sliding fitting 32 and the fixing member 31 is relatively simple, thus simplifying the slide rail component 30. The fixing member 31 and the sliding fitting 32 are both configured as integrally formed bending pieces.

The number of the drawer 20 may be multiple, that is, and a plurality of the drawers 20 are arranged along a height direction H of the storage box 100. In this way, the first accommodation space 16 is divided into a plurality of independent small spaces, which is convenient for users to classify and summarize a stored items and improve a storage effect.

Referring to FIG. 3, a side of each of the two first side walls 11 away from the second side wall 12 is provided with a stopping portion 111 and the stopping portion 111 is configured for preventing the mounting frame 40 from escaping out of the first accommodation space 16 in a direction away from the second side wall 12. In this way, an assembly firmness between the mounting frame 40 and the two first side walls 11 can be improved.

Furthermore, the stopping portion 111 includes a first edgefold 111*a* and a second edgefold 111*b* which are arranged at an included angle, the first edgefold 111*a* is connected to the two first side walls 11, and the second edgefold 111*b* is arranged opposite to the two first side walls. The mounting frame 40 includes a mounting portion 41 and an abutting portion 42 (i.e., a first abutting portion 42*a* and a second abutting portion 42*b*) which are arranged at an included angle, and the abutting portion 42 (i.e., the first abutting portion 42*a*) is in contact with the first edgefold 111*a* to prevent the mounting frame 40 from detaching from the two first side walls 11 in a direction away from the second side wall 12. The mounting portion 41 is in contact with the second edgefold 111*b* to prevent the mounting frame 40 from detaching from the two first side walls 11 and moving toward a center of the first accommodation space 16. The second abutting portion 42*b* abuts against the second side wall 12.

In this way, the mounting frame 40 can be firmly connected to the two first side walls 11 without welding. When assembling the storage box 100, the drawer 20 can be pre-installed on the mounting frame 40. Then, along the height direction H of the storage box 100, the drawer 20 and the mounting frame 40 are loaded into the first accommodation space 16 from a side away from the bottom wall 13.

The two first side walls 11, the first edgefold 111*a* and the second edgefold 111*b* are formed as an integrated structure. The number of the abutting portion 42 is two, and the two abutting portions 42 are connected to opposite ends of the mounting portion 41, respectively. In addition, the two abutting portion 42 and the mounting portion 41 are integrally molded. The two abutting portion 42 may both extend towards the same side of the mounting portion 41, or they may respectively extend towards both sides of the mounting portion 41.

Furthermore, a step structure 411 is formed by a position of the mounting portion 41 adjacent to the first abutting portion 42*a* being depressed toward a direction adjacent to the first side walls 11, and the second edgefold 111*b* is attached to the step structure 411. In this way, not only can the bonding degree between the second edgefold 111*b* and the mounting portion 41 be improved, but also the step structure 411 can form a stop for an end of the second edgefold 111*b* and to further prevent the mounting frame 40 from detaching from the first side walls 11 away from the second side wall 12.

Referring to FIG. 5 to FIG. 11, the storage box 100 further includes an abutting portion 50, and the abutting portion 50 includes a first section 51 and a second section 52 which are connected. The first section 51 is fixedly connected to the cover 15, and the second section 52 extends into the first accommodation space 16. With a rotation of the cover 15 relative to the second side wall 12, the second section 52 can be moved to insert into the drawer 20 and block the drawer 20 from moving away from the second side wall 12. Alternatively, the second section 52 can be moved away from the drawer 20 to allow the drawer 20 to move away from the second side wall 12.

With a provision of the abutting portion 50, the drawer 20 is locked to the second side wall 12 during a transportation of the storage box 100, and will not accidentally slide out, thus contributing to the improvement of a transportation safety of the storage box 100. In addition, the user can not only open or close the first accommodation space 16 by turning the cover 15, but also drive the abutting portion 50 to move through the cover 15 to lock or unlock the drawer 20. Specifically, when the cover 15 rotates in a direction adjacent to the bottom wall 13 to close the storage box 100, the second section 52 moves to insert into the drawer 20. When the cover 15 is turned outwards to open the storage box 100, the second section 52 can be moved out of the drawer 20.

The abutting portion 50 further includes a spring section 53, and the first section 51 is rotatably connected to the second section 52 through the spring section 53. The storage box 100 further includes a guide 60, which is fixed on the second side wall 12, and the second section 52 is slidably installed on the guide 60.

By providing the spring section 53, a rotation of the first section 51 following the cover 15 can be converted into a sliding of the second section 52. Furthermore, the guide 60 plays a guiding role in the second section 52, so that the second section 52 can slide more smoothly to insert into or detach from the drawer 20.

An end of the second section 52 away from the spring section 53 is configured as a hook bent away from the second side wall 12. In this way, it is convenient to insert the end of the second section 52 away from the spring section 53 into the drawer 20.

Figure 12:
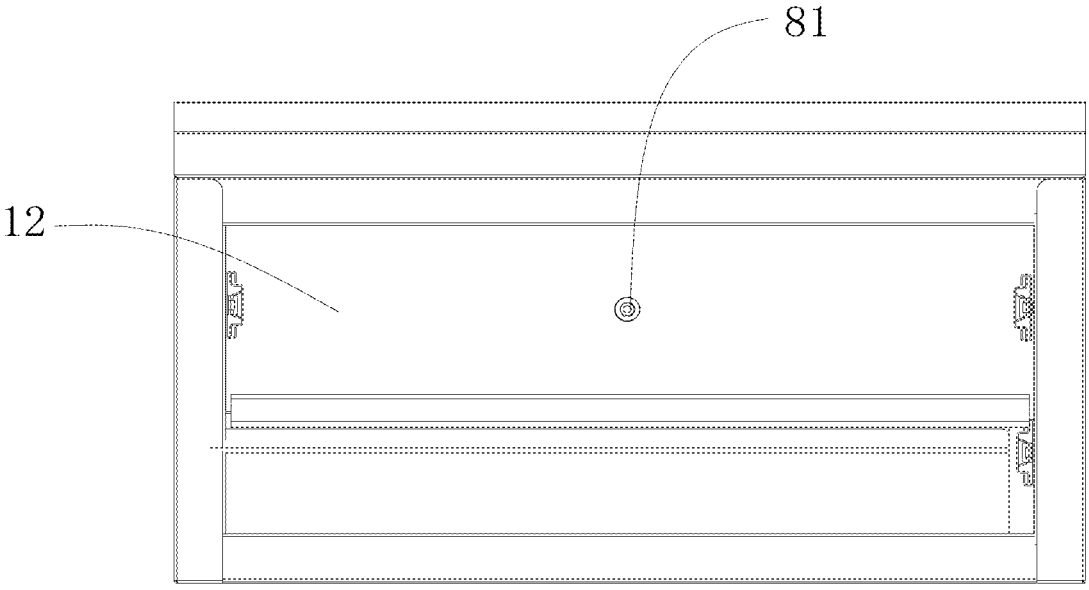
FIG. 12 is a front view of the box assembly in the present disclosure.
Figure 13:
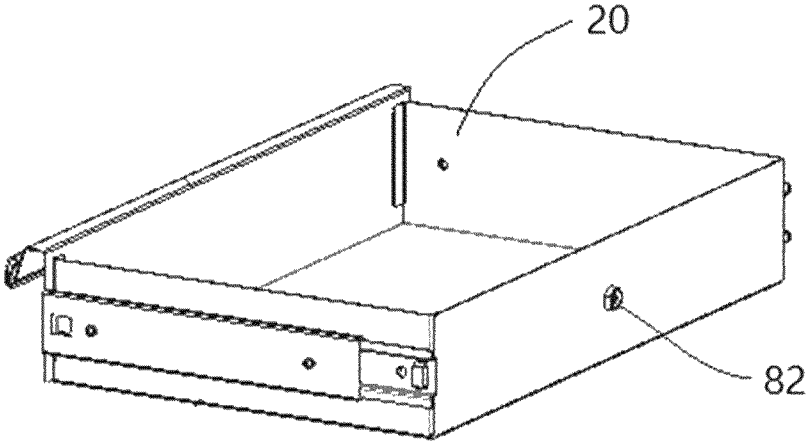
FIG. 13 is a schematic view of a drawer in the present disclosure.
Figure 14:
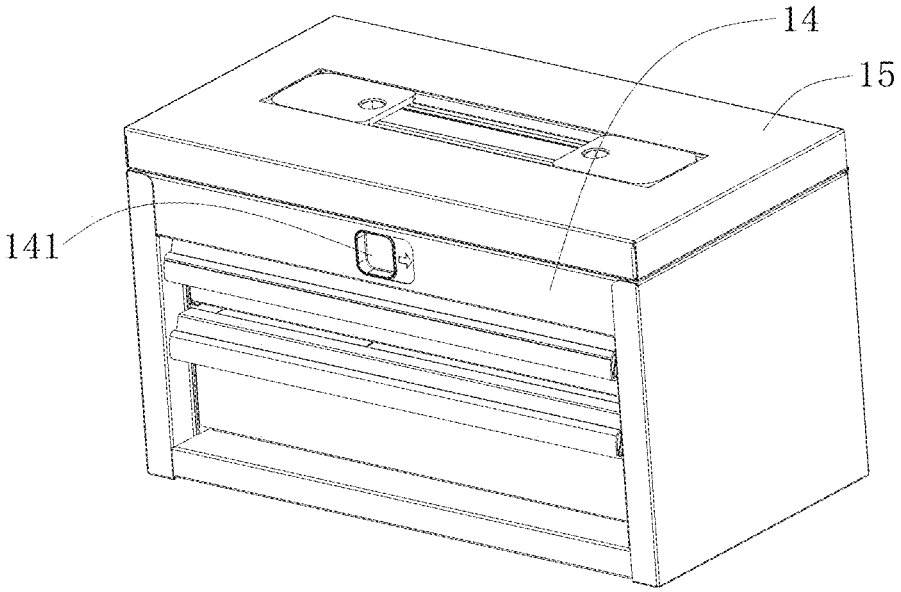
FIG. 14 is a schematic view of a storage box according to an embodiment in the present disclosure.
Figure 15:
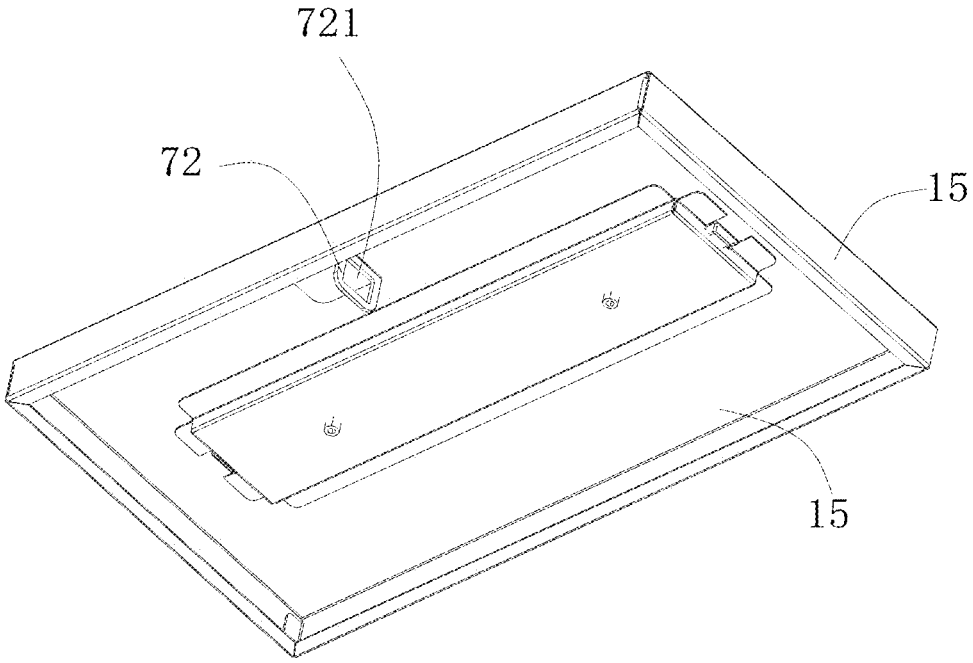
FIG. 15 is a view of the cover of the storage box shown in FIG. 14.

Referring to FIG. 12 to FIG. 13, the storage box 100 further includes a first magnet 81 and a second magnet 82, the first magnet 81 is fixedly connected to the second side wall 12, the second magnet 82 is fixedly connected to a side of the drawer 20 adjacent to the second side wall 12, the drawer 20 is capable of being adsorbed on the second side wall 12 through a mutual attraction between the first magnet 81 and the second magnet 82. In this way, it is beneficial to lock the drawer 20 to the second side wall 12 more firmly, so as to prevent the drawer 20 from accidentally slipping out.

The first magnet 81 and the second magnet 82 may be magnets. Alternatively, one of the first magnet 81 and the second magnet 82 may be a magnet, and the other of the first magnet 81 and the second magnet 82 is made of iron.

Referring to FIG. 2 to FIG. 17, the storage box 100 further includes a top wall 14, and the top wall 14 is fixedly connected with the first side walls 11 and the second side wall 12, respectively. And the top wall 14 is relatively located above the drawer 20 along the height direction H of the storage box 100, and the top wall 14 and the cover 15 are enclosed above the drawer 20 to form a second accommodation space 17.

It should be noted that "above the drawer 20" here refers to a side of the drawer 20 away from the bottom wall 13. By providing the second accommodation space 17, a storage space of the storage box 100 is increased, which is beneficial to further improve a storage capacity of the storage box 100.

Referring to FIG. 5, FIG. 6, FIG. 14 to FIG. 18, the storage box 100 further includes a safety lock 70, which is installed at a junction of the cover 15 and the top wall 14. The safety lock 70 is configured for locking the cover 15 to the top wall 14. When the safety lock 70 is locked, the cover 15 can not be turned out and opened, and the drawer 20 can not slide away from the second side wall 12.

Two structural forms of the safety lock 70 are described below.

EXAMPLE 1

Figure 5:
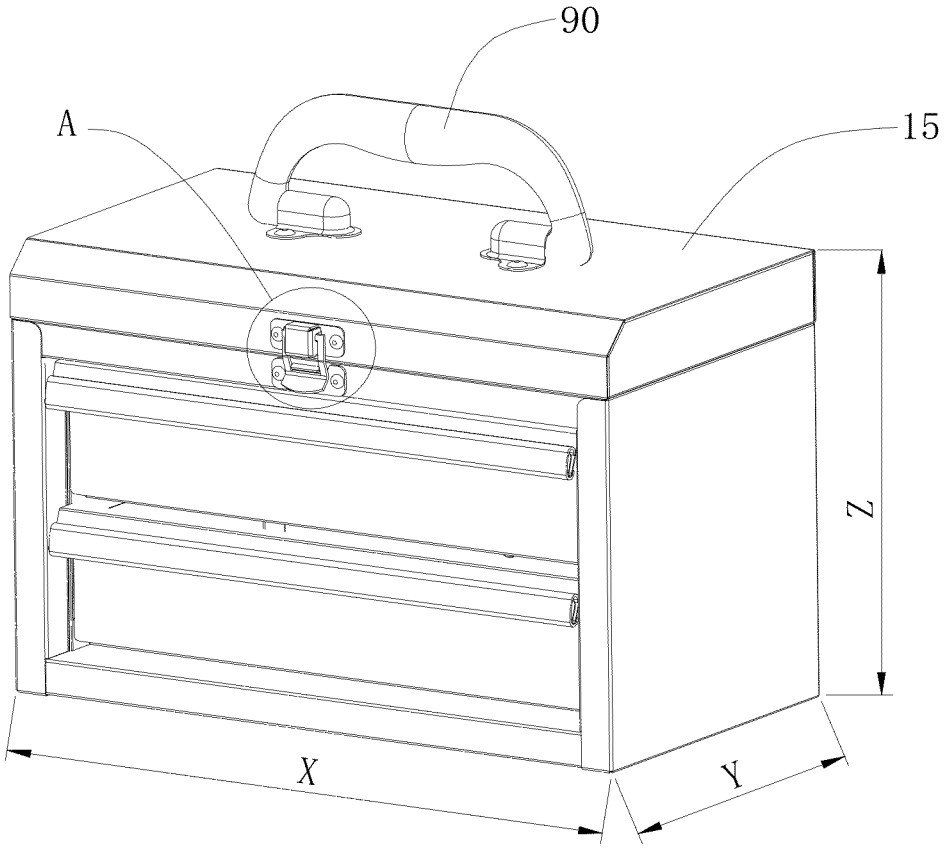
FIG. 5 is a schematic view of a storage box according to an embodiment in the present disclosure.
Figure 6:
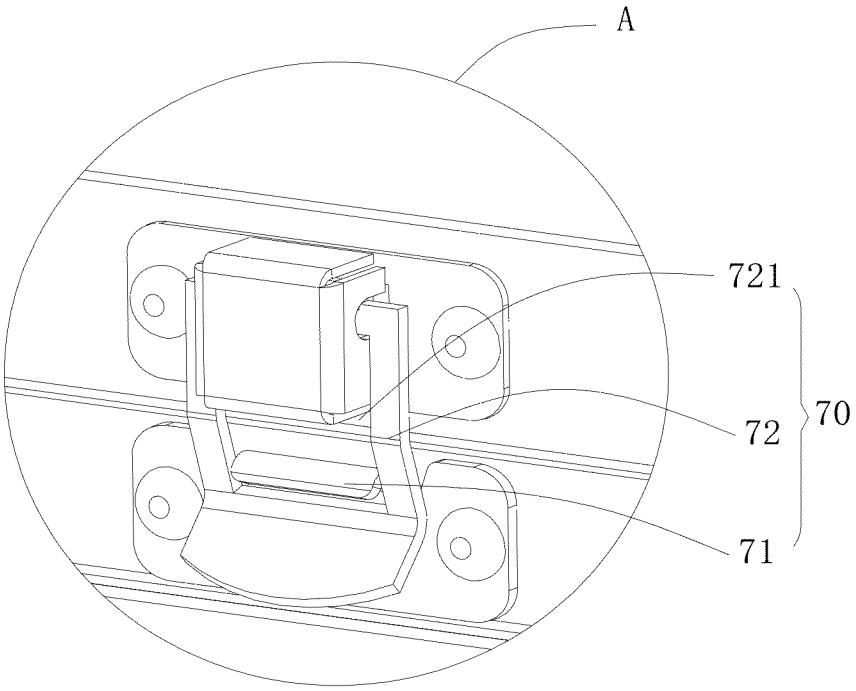
FIG. 6 is an enlarged view of portion A of the storage box in FIG. 5.
Figure 7:
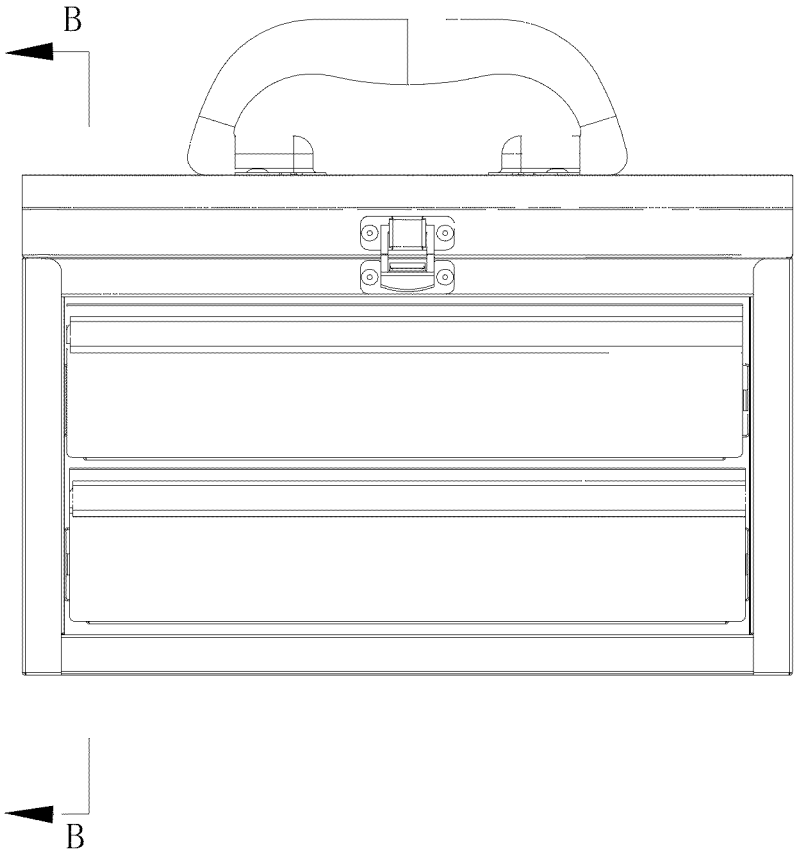
FIG. 7 is a front view of the storage box in FIG. 5.
Figure 8:
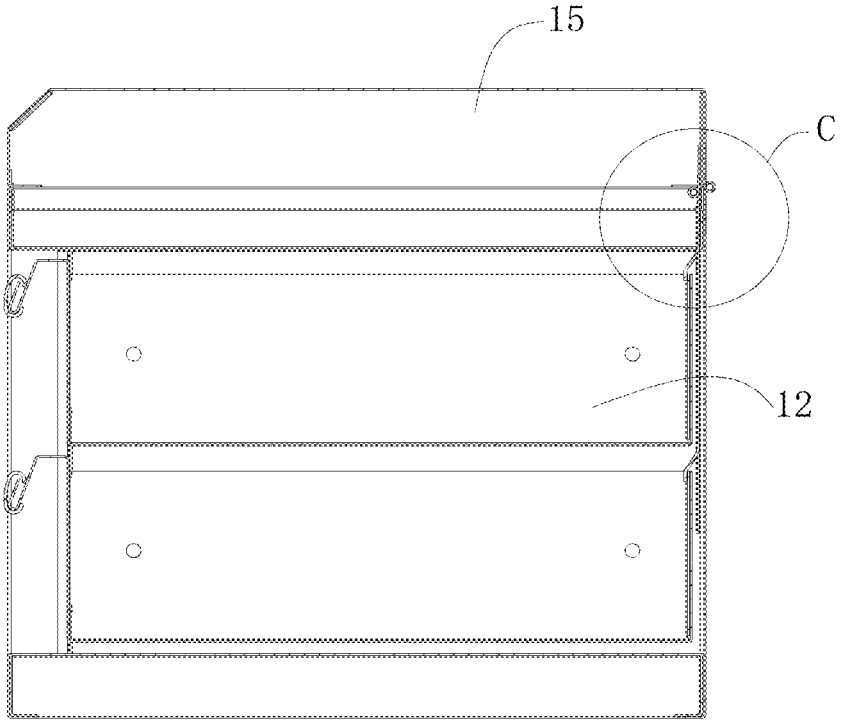
FIG. 8 is a cross-sectional view of the storage box of FIG. 7 at B-B in a closed state.
Figure 9:
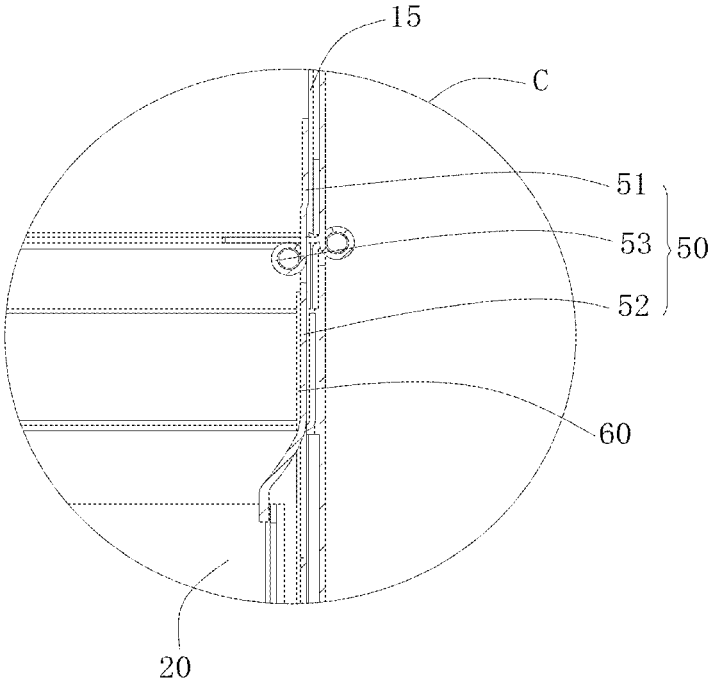
FIG. 9 is an enlarged view of portion C in FIG. 8.
Figure 10:
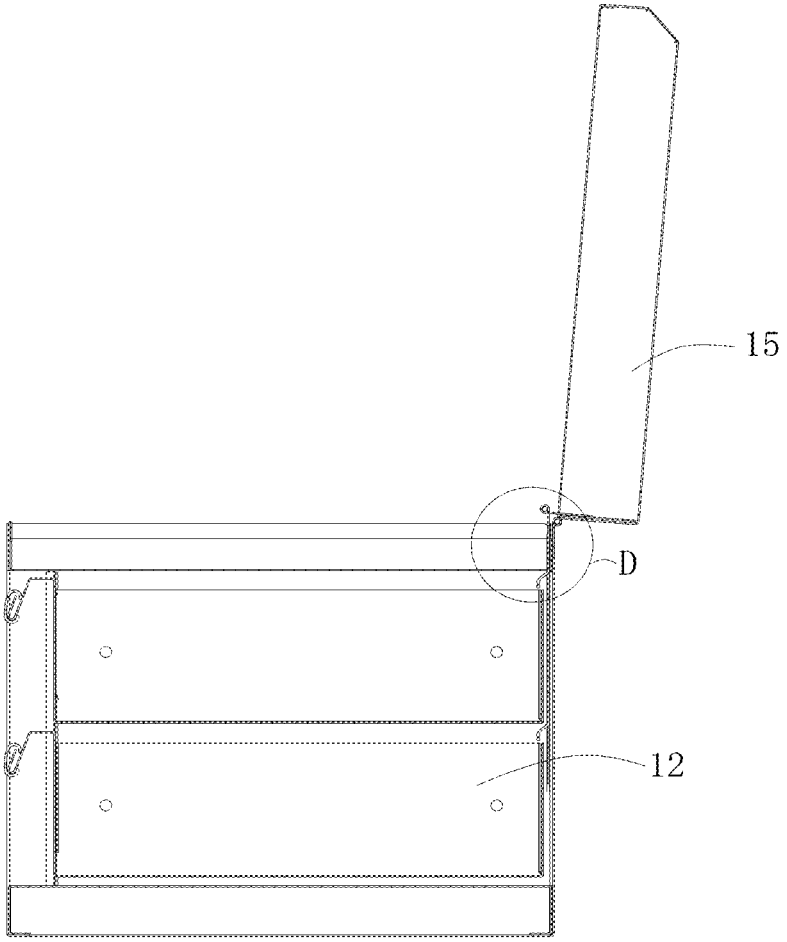
FIG. 10 is a cross-sectional view of the storage box of FIG. 7 at B-B in an open state.
Figure 11:
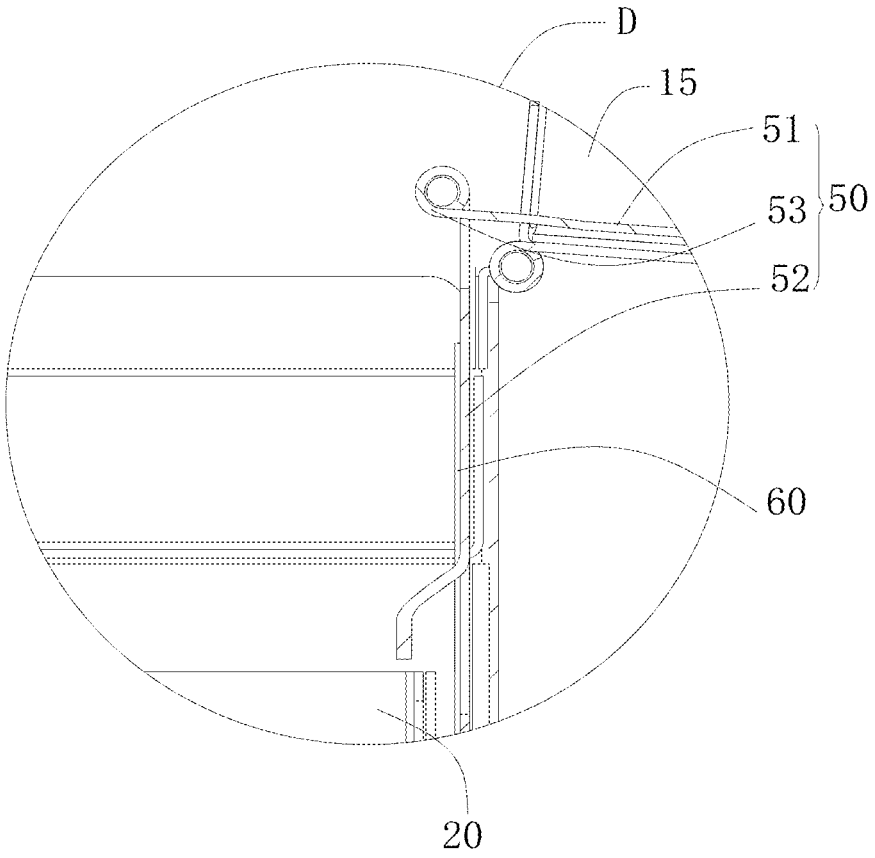
FIG. 11 is an enlarged view of portion D of the storage box in FIG. 10.

Referring to FIG. 5 and FIG. 6, the safety lock 70 includes a locking hook 71 and a locking catch 72, the locking hook 71 is fixedly connected to an outer wall of one of the cover 15 and the top wall 14, the locking catch 72 is rotatably connected to an outer wall of the other one of the cover 15 and the top wall 14. The locking catch 72 includes a locking hole 721, the locking catch 72 is capable of rotating to be sleeved on a periphery of the locking hook 71 through the locking hole 721. The locking catch 72 matches with the locking hook 71 and is limited by the locking hook 71.

The user only needs to close the cover 15, and then rotate the locking catch 72, so that the locking catch 72 is sleeved on the periphery of the locking hook 71 through the locking hole 721 to complete the locking of the cover 15. Such operation is simple.

EXAMPLE 2

Referring to FIG. 14 to FIG. 18, the safety lock 70 is located in the second accommodation space 17. The safety lock 70 includes a locking hook 71 and a locking catch 72, the locking catch 72 is fixedly connected to the cover 15, and the locking catch 72 is provided with a locking hole 721. The top wall 14 is provided with a through hole 141, the locking hook 71 is slidably connected to the top wall 14, and at least one part of the locking hook 71 is exposed through the through hole 141. The locking hook 71 can slide into the locking hole 721 and engage with the locking hole 721 in a limited way. In this way, the safety lock 70 is located in the second accommodation space 17, which makes an external shape of the storage box 100 more concise and beautiful. The user can dials the locking hook 71 through the through hole 141 to slide relative to the top wall 14.

Figure 17:
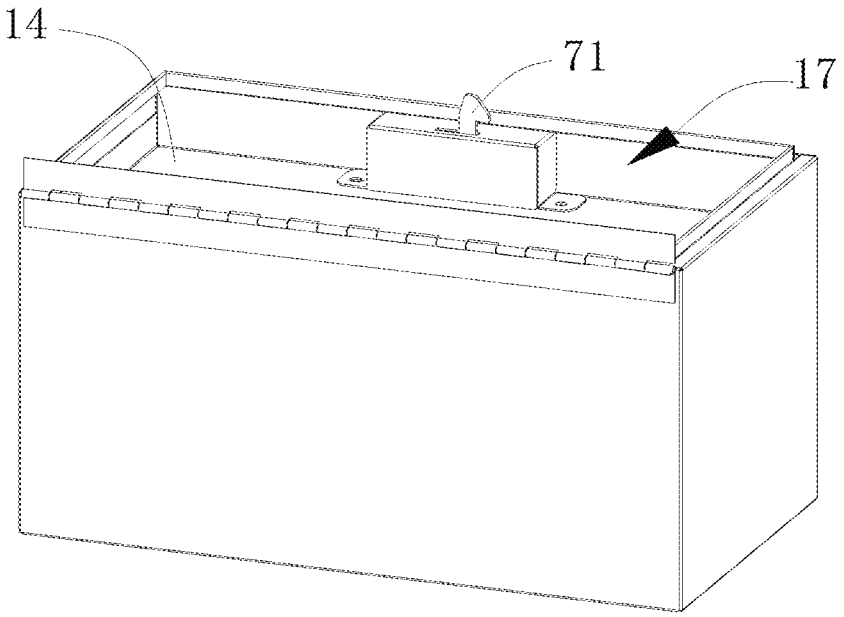
FIG. 17 is a partial view of the storage box in FIG. 14.
Figure 18:
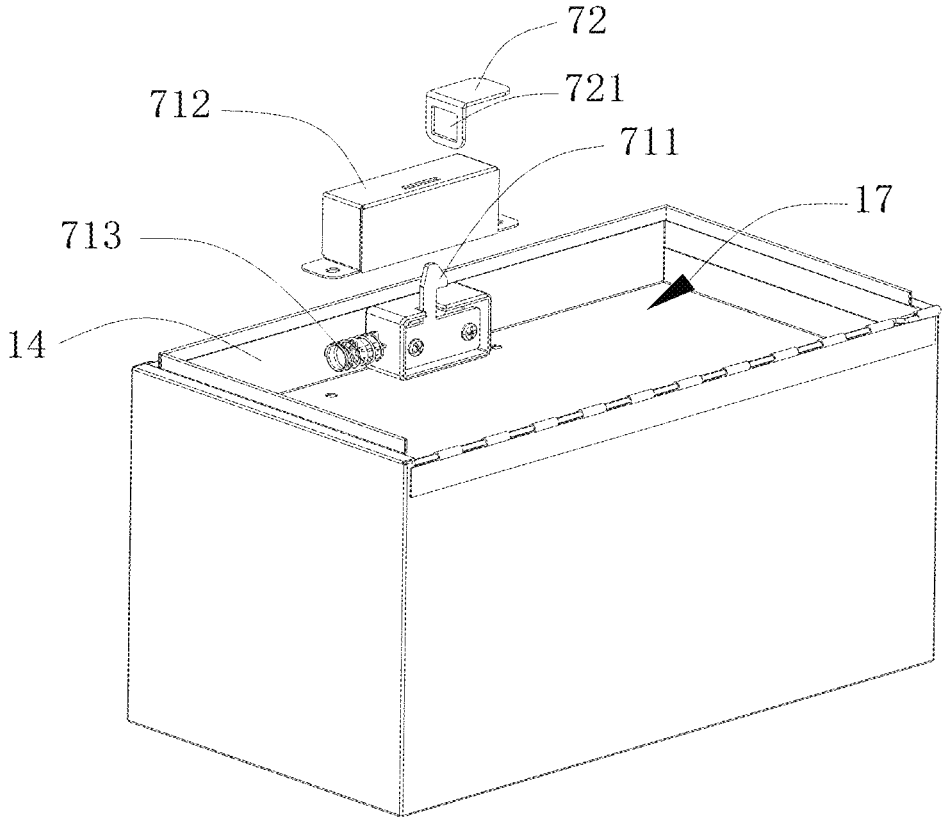
FIG. 18 is an exploded view of the storage box in FIG. 17.

Specifically, referring to FIG. 17, the locking hook 71 includes a hook body 711, a shell 712 and an elastic return member 713. The shell 712 is fixedly connected to the top wall 14, and the locking hook 71 and the elastic return member 713 are located in the shell 712, respectively. The elastic return member 713 is located on a side of the locking hook 71 towards away from the locking catch 72, and one end of the elastic return member 713 is fixedly connected to an inner wall of the shell 712, and the other end of the elastic return member 713 abuts against the locking hook 71. When the user slides the locking hook 71, so that the locking hook 71 moves away from the locking catch 72 and detach from the locking catch 72, the locking hook 71 compresses the elastic return member 713. When a force exerted by the user on the locking hook 71 disappears, the elastic return member 713 pushes the locking hook 71 to reset.

The storage box 100 further includes a handle 90, which is connected to the cover 15. The user can move the storage box 100 by holding the handle 90.

Figure 16:
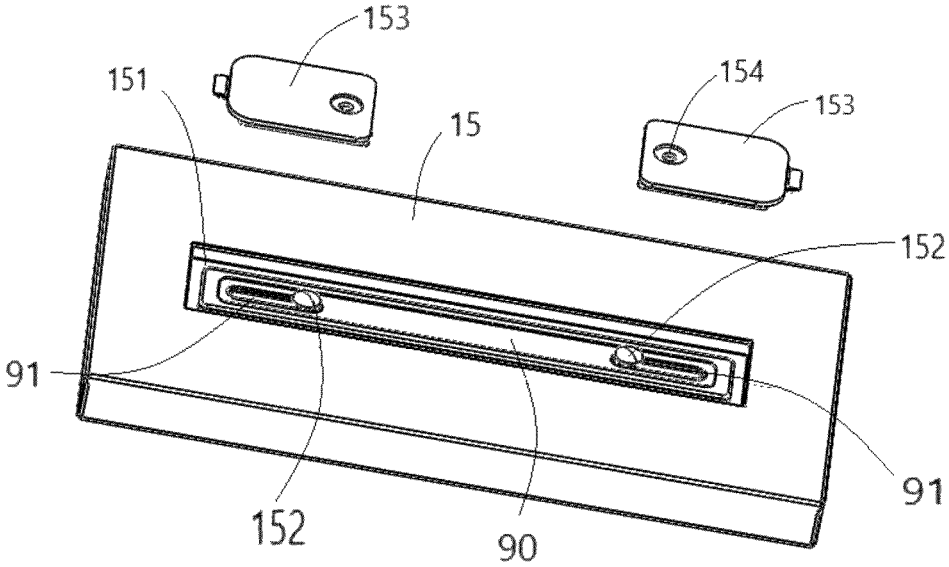
FIG. 16 is a schematic view of a cover of the storage box in FIG. 14 from another perspective.

Referring to FIG. 16, the cover 15 is provided with a groove 151, the handle 90 is accommodated in the groove 151, and two ends of the handle 90 are slidably connected to bottom of the groove 151. When an external force acts on the handle 90, the two ends of the handle 90 can approach towards each other, so that an operation space (not shown) is formed between the middle of the handle 90 and the cover 15.

In this way, the handle 90 can be hidden in the groove 151 when not in use, thus making the appearance of the storage box 100 more concise and beautiful. When the storage box 100 is in use state, it is only necessary to pull the handle 90 away from the cover 15 to form the operation space, so as to facilitate the user to hold the handle 90. The handle 90 is made of flexible materials such as plastic.

In an embodiment, the cover 15 is provided with two limiting columns 152, the two limiting columns 152 are arranged in the groove 151 at intervals, two end parts of the handle 90 are provided with an elongated hole 91, respectively. The elongated hole 91 extends along a length direction of the handle 90, each of the two limiting columns 152 penetrates through one of the elongated holes 91, and an end of each of the two limiting columns 152 away from the cover 15 is in contact with an edge of the elongated hole 91, and each of the two limiting columns 152 is capable of movably matching with the elongated hole 91 along the length direction of the handle 90. Each of the two limiting columns 152 penetrates through an elongated hole 91, and the end of the limiting column 152 away from the cover 15 is in contact with the edge of the elongated hole 91, and each of the two limiting columns 152 can movably match with the hole 91 along the length direction of the handle 90. In this way, each of the two limiting columns 152 movably matches with the elongated hole 91 along the length direction of the handle 90, so that the two ends of the handle 90 can approach towards each other. The cover 15 is further provided with a limiting member 153. The limiting member 153 is provided with a clamping hole 154 for crimping on the handle 90, and the limiting member 153 is connected to each of the two limiting column 152 through the clamping hole 154.

Alternatively, the two limiting columns 152 may be set at two ends of the handle 90, and the two elongated holes 91 may be set at intervals on the bottom of the groove 151.

Of course, in other embodiments, referring to FIG. 4, both ends of the handle 90 can also be directly fixed on the cover 15.

Referring to FIG. 5, a length of the storage box 100 is defined as X, the length X of the storage box 100 is in a range of 200 mm to 600 mm, a width of the storage box 100 is defined as Y, the width Y of the storage box 100 is in a range of 100 mm to 400 mm, and a height of the storage box 100 is defined as Z, the height Z of the storage box 100 is in a range of 100 mm to 600 mm.

Figure 19:
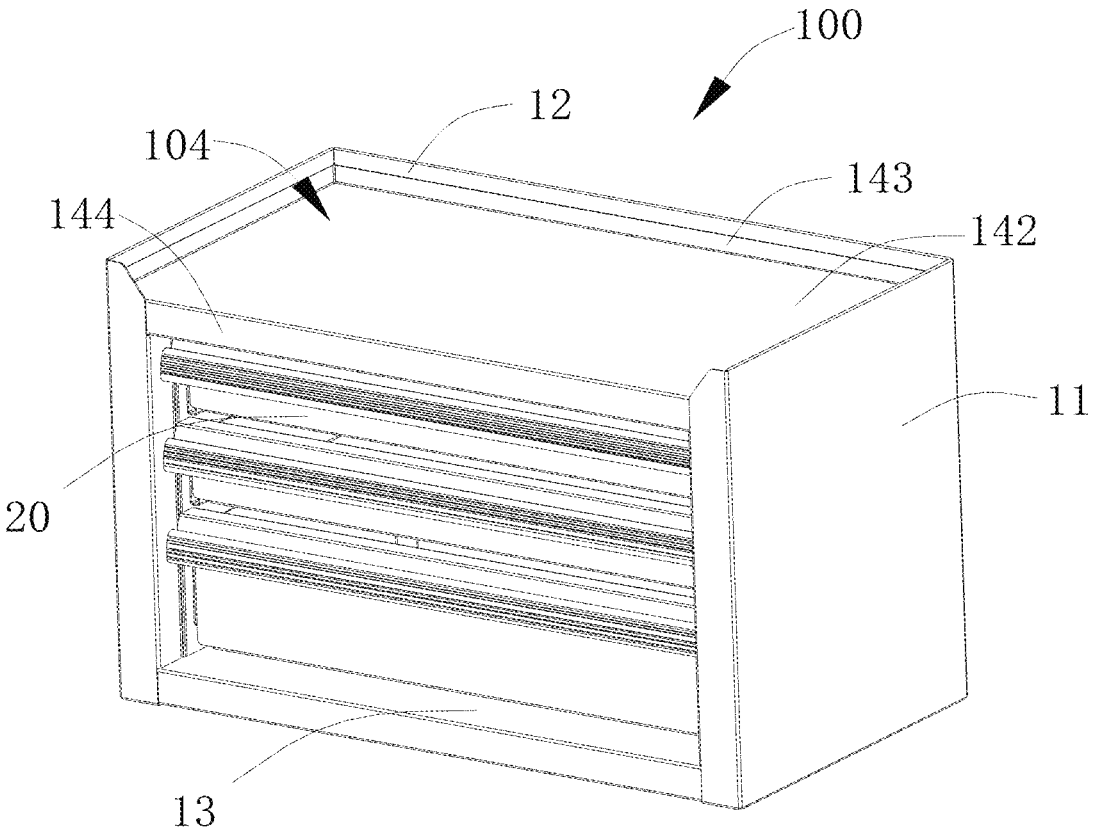
FIG. 19 is a schematic view of a storage box according to an embodiment in the present disclosure.
Figure 20:
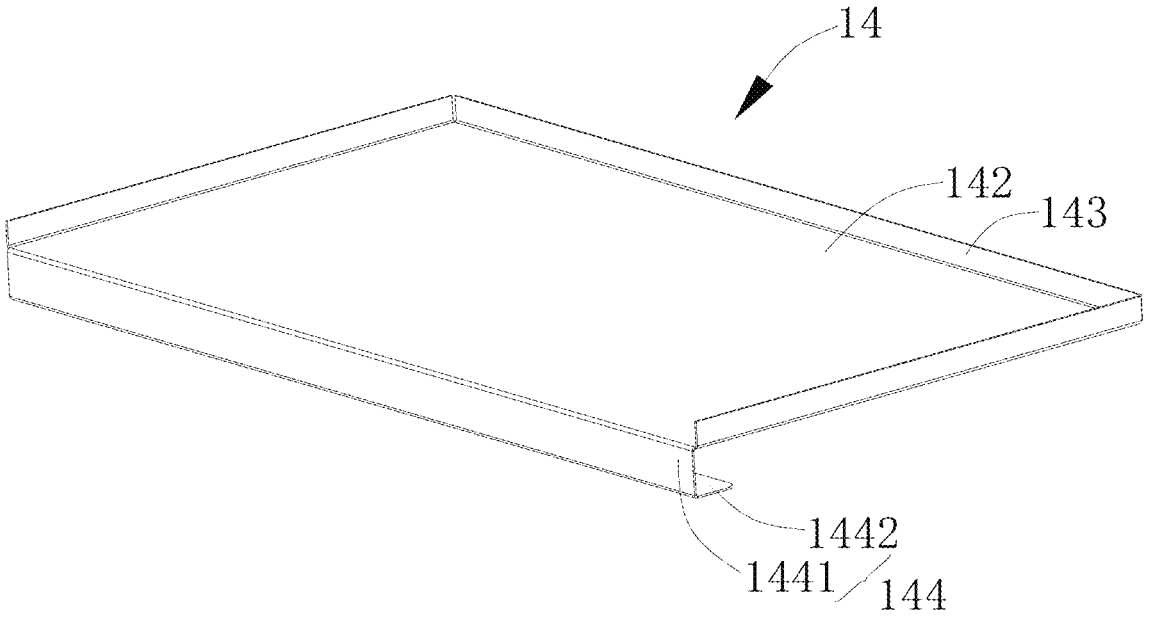
FIG. 20 is a view of a top wall of the storage box in FIG. 19.
Figure 21:
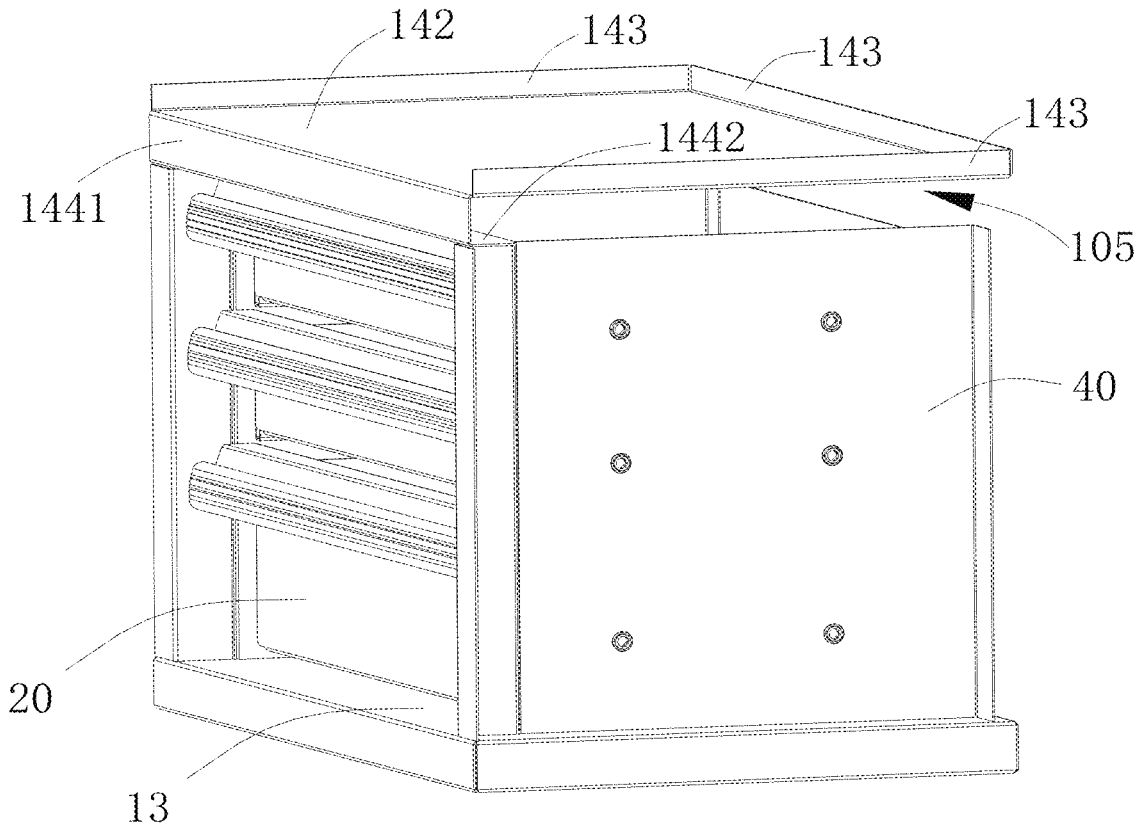
FIG. 21 is a partial view of the storage box in FIG. 19.

Referring to FIG. 19 to FIG. 21, another embodiment of the present disclosure provides a storage box 100. Most structure of the storage box 100 in this embodiment is the same as the storage box 100 of the above embodiment. In this embodiment, the top wall 14 of the storage box 100 is fixedly connected with the first side walls 11 and the second side wall 12, and the top wall 14 is relatively located above all the drawer 20 along the height direction H of the storage box 100. Furthermore, the top wall 14 includes a shelf 142 parallel to the bottom wall 13, and along a height direction of the storage box 100, a height of the shelf 142 is lower than top edges of the first side walls 11 and the second side wall 12 which are away from the bottom wall 13. The top wall 14, the first side walls 11 and the second side wall 12 are enclosed above the drawers 20 to form a third accommodation space 104. In other words, the top wall 14 sinks relative to the first side walls 11 and the second side wall 12, thus forming a third accommodation space with a certain depth for safer placing of articles.

In this embodiment, the storage box 100 may not be provided with a cover 15, that is, the third accommodation space 104 includes an opening opposite to the bottom wall 13, so that users can directly store articles on the shelf 142. And because the height of the shelf 142 is lower than the top edges of the first side walls 11 and the second side wall 12 which are away from the bottom wall 13, articles are not easy to fall from the third accommodation space 104, and it is more convenient to retrieve.

Referring to FIG. 19 to FIG. 21, furthermore, in order to facilitate a connection of the top wall 14 with the first side walls 11 and the second side wall 12, in this embodiment, the top wall 14 further includes a side plate 143 extending from an edge of the shelf 142. The side plate 143 is used for being connected with the first side walls 11 or the second side wall 12. A connection mode by welding is simple in operation, low in cost and firm in connection effect. Optionally, in this embodiment, the side plate 143 is perpendicular to the shelf 142.

Referring to FIG. 20 to FIG. 21, specifically, in this embodiment, the edge of the shelf 142 adjacent to the second side wall 12 and the edge of the shelf 142 adjacent to the first side walls 11 are each provided with the side plate 143, respectively. In order to further ensure connection firmness between the top wall 14, the first side walls 11 and the second side wall 12, and further ensure a placement stability of articles placed in the shelf 142. It can be understood that a width of a connection between the side plate 143 and the shelf 142 is not limited here, and the side plate 143 may extend along only part of the edge of each side of the shelf 142 or all the edges of each side of the shelf 142.

Furthermore, the extension direction of the side plate 143 is away from the bottom wall 13. It is convenient for welding. Furthermore, the side plate 143 does not protrude from the third accommodation space 104. With this arrangement, a material consumption is reduced and aesthetics and safety are ensured.

It can be understood that in other embodiments, the extension direction of the side plate 143 can also toward the bottom wall 13, as long as the connection between the top wall 14, the first side wall 11 and the second side wall 12 is not affected.

In order to facilitate welding the side plate 143 with the first side walls 11 and the second side wall 12, the side plate 143 is parallel to the first side walls 11 and the second side wall 12. In other words, the extending direction of the side plate 143 is perpendicular to the bottom wall 13. It can be understood that in other embodiments, the side plate 143 may be slightly inclined as long as it does not affect the welding of the side plate 143 with the first side walls 11 and the second side wall 12.

Furthermore, the top wall 14 further includes a buffet 144, the buffet 144 includes a first plate body 1441 and a second plate body 1442 which are bent and connected with each other. The first plate body 1441 extends toward the bottom wall 13 along an edge of the shelf 142 away from the second side wall 12, and the second plate body 1442 extends toward the second side wall 12 along an edge of the first plate body 1441 away from the shelf 142.

With this arrangement, the first plate body 1441 can prevent the edge of the shelf 142 away from the second side wall 12 from scratching the user. The second plate body 1442 can cooperate with the first plate body 1441 to make a certain gap 105 between the drawer 20 and the shelf 142, so that the top drawer 20 is not easy to collide or rub with the shelf 142 after placing articles. And the second plate body 1442 can also prevent the edge of the first plate body 1441 from scratching the user.

It should be noted that "bent and connected with each other" means that the edges of the first plate body 1441 and the second plate body 1442 are connected, and there is a preset included angle between a plate surface of the first plate body 1441 and a plate surface of the second plate body 1442. The preset included angle is less than or equal to 90 degrees.

Referring to FIG. 19 to FIG. 21, furthermore, in this embodiment, the first plate body 1441 extends toward and perpendicular to the bottom wall 13 along the edge of the shelf 142 which is away from the second side wall 12. The second plate body 1442 extends toward and perpendicular to the second side wall 12 along the edge of the first plate body 1441 which is away from the shelf 142. In other words, an included angle between the first plate body 1441 and the shelf 142 is 90 degrees, and an included angle between the second plate body 1442 and the first plate body 1441 is also 90 degrees.

It can be understood that in other embodiments, the included angle between the first plate body 1441 and the shelf 142 can also be less than 90 degrees, and the included angle between the second plate body 1442 and the first plate body 1441 can also be less than 90 degrees.

It should be further explained that an extension length of the first plate body 1441 towards the bottom wall 13 and an extension length of the second plate body 1442 towards the second side wall 12 are not suitable to be too long, and can be selected according to specific conditions, as long as the extension length does not affect the normal use of the storage box 100.

Referring to FIG. 20 to FIG. 21, the extension length of the second plate body 1442 towards the second side wall 12 is less than or equal to the extension length of the first plate body 1441 towards the bottom wall 13. In order to ensure the normal function of the second plate body 1442 and the first plate body 1441, and materials used are more streamlined.

Referring to FIG. 21, in this embodiment, the plate surface of the second plate body 1442 adjacent to the bottom wall 13 can be in contact with a top of the mounting frame 40, and the mounting frame 40 can play a certain supporting role, further ensuring the stability of the shelf 142.

The technical features of the above-mentioned embodiments can be combined arbitrarily. In order to make the description concise, not all possible combinations of the technical features are described in the embodiments. However, as long as there is no contradiction in the combination of these technical features, the combinations should be considered as in the scope of the present disclosure.

One of ordinary skill in the art should recognize that the above embodiments are used only to illustrate the present disclosure and are not used to limit the present disclosure, and that appropriate variations and improvements to the above embodiments fall within the protection scope of the present disclosure so long as they are made without departing from the substantial spirit of the present disclosure.

What is claimed is:

1. A storage box, comprising two first side walls, a second side wall and a bottom wall, the two first side walls are connected to two sides of the second side wall, respectively; and the two first side walls are opposite to each other, the second side wall and the two first side walls are fixedly connected to the bottom wall, respectively; and the bottom wall, the second side wall and the two first side walls are enclosed together to form a first accommodation space; the two first side walls extend from opposite ends of the second side wall, the second side wall and the two first side walls form a one-piece article;

the storage box further comprises a cover and a drawer, wherein the cover is connected to a side of the second side wall away from the bottom wall and is capable of rotating relative to the second side wall, the drawer is installed in the first accommodation space and is capable of sliding towards or away from the second side wall;

the storage box further comprises a slide rail component and a mounting frame, wherein the mounting frame is fixedly connected to the two first side walls, and the drawer is slidable and matches with the mounting frame through the slide rail component;

wherein a side of each of the two first side walls away from the second side wall is provided with a stopping portion and the stopping portion is configured for preventing the mounting frame from escaping out of the first accommodation space in a direction away from the second side wall; the stopping portion comprises a first edgefold and a second edgefold which are arranged at an included angle, the first edgefold is connected to the two first side walls, and the second edgefold is arranged opposite to the two first side walls;

the mounting frame comprises a mounting portion, a first abutting portion, and a second abutting portion, the mounting portion and the first abutting portion are arranged at an included angle, the mounting portion and the second abutting portion are arranged at an included angle, and the first abutting portion and the second abutting portion are arranged at opposite ends of the mounting portion, the first abutting portion is in contact with the first edgefold to prevent the mounting frame from detaching from the two first side walls in a direction away from the second side wall, the second abutting portion abuts against the second side wall; the mounting portion is in contact with the second edgefold to prevent the mounting frame from detaching from the two first side walls and moving toward a center of the first accommodation space, a step structure is formed by a position of the mounting portion adjacent to the first abutting portion being depressed toward a direction adjacent to the first side walls, and the second edgefold is in contact with the step structure;

the first abutting portion is parallel to the first edgefold, and the first abutting portion is in face-to-face fit with the first edgefold.

2. The storage box of claim 1, wherein the slide rail component comprises a fixing member and a sliding fitting, wherein the fixing member is fixed on the mounting frame, the sliding fitting is fixed on the drawer, and the sliding fitting is slidably connected to the fixing member.

3. The storage box of claim 2, wherein the fixing member is provided with a chute, the sliding fitting is provided with a flange, and the flange is slidably disposed in the chute.

* * * * *